US006205583B1

(12) United States Patent
Beland

(10) Patent No.: US 6,205,583 B1
(45) Date of Patent: Mar. 27, 2001

(54) ADJUSTABLE ELBOW PAD

(75) Inventor: Jean-Francois Beland, St-Laurent (CA)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/650,383

(22) Filed: Aug. 29, 2000

(30) Foreign Application Priority Data

Sep. 1, 1999 (CA) ..... 2281310

(51) Int. Cl.[7] ..... A41D 13/00

(52) U.S. Cl. ..... 2/16; 2/16; 2/22; 128/881; 602/26

(58) Field of Search ..... 2/16, 455, 22, 2/24, 911; 128/878, 881, 882; 602/23, 26, 62

(56) References Cited

U.S. PATENT DOCUMENTS

Re. 30,501 * 2/1981 Almeida ..... 128/80 C
4,599,748 * 7/1986 Garcia ..... 2/22
4,627,108 * 12/1986 Jarvinen ..... 2/22
5,031,240 * 7/1991 Niehaus ..... 2/24
5,652,956 * 8/1997 Hoshizaki et al. ..... 2/22
5,715,535 * 2/1998 Hamilton et al. ..... 2/59
5,732,411 * 3/1998 Coleman et al. ..... 2/22
5,915,529 * 6/1999 Popowski ..... 2/16
6,076,185 * 6/2000 Schramm ..... 2/16

* cited by examiner

*Primary Examiner*—John J. Calvert
*Assistant Examiner*—Tejash Patel
(74) *Attorney, Agent, or Firm*—Ratner & Prestia

(57) ABSTRACT

An adjustable elbow pad for playing hockey and other similar sporting activities adapted to cover the gap between a protective glove and a shoulder pad and more particularly adapted for use by children in their years of growth. The elbow pad is adjustable in length and diameter to accommodate the increase in size and length of a growing child and also to accommodate varying gaps between protective glove and shoulder pad when one of these two protective equipments is replaced. The adjustable elbow pad comprises an elbow protector and a forearm protector telescopingly joined together, and locking means for locking the forearm protector to the elbow protector at least when worn.

24 Claims, 10 Drawing Sheets

ADJUSTABLE ELBOW PAD

FIELD OF THE INVENTION

The invention relates to an adjustable elbow pad for playing hockey and other similar sporting activities where protection of the elbow joints is essential to prevent painful blows to this sensitive area of the arm where the cubitus bone is vulnerable at the elbow point, and to protect the areas directly below and above the elbow joint, namely the upper forearm and the lower biceps region. The invention is also concerned with elbow pads used by children in their years of growth.

BACKGROUND OF THE INVENTION

Typical hockey elbow pads are usually a one piece padding element which is made of a combination of foamy absorbing material surrounding and cupping the exterior area of the elbow joints and the adjacent areas above and below the elbow joints, sometimes complemented with a rigid shell cap positioned over the foamy absorbing material directly above the elbow point. The elbow pad is held in place by a pair of elastic bands above and below the elbow joint sewn or otherwise connected to the padding element which closes the elbow pad over the upper arm and the forearm leaving the inside of the elbow joint free to flex as well as marginally exposed to blows.

Elbow pads come in a variety of sizes to accommodate players of different sizes and shapes. Elbow pads are designed to protect the gap between the protective glove, which covers the hand, the wrist and the lower forearm of the player, and the shoulder pad, which covers the chest, the shoulder and upper part of the biceps region of the arm. This gap varies with the sizes and shapes of the neighboring protective equipment and with the sizes and shapes of players.

Young players in their years of growth go through many sizes of protective equipment as they grow in sizes and as their protective equipment wears out. As the young player grows the gap between the protective glove and the upper arm protector of the shoulder pad increases rapidly, leaving portions of the arm unprotected. The elbow pad that was adequately covering the elbow area a year earlier, now leaves a portion of the arm unprotected and must be replaced. The elbow pad may still be in good condition but must be replaced as it no longer adequately protects the elbow area of the growing player.

The shoulder pad and the protective gloves may also be in good condition but often, young players or their parents will renew the entire protective equipment at the same time, thinking their child has outgrown it, adding substantial cost to the replacement of protective equipment of a growing player over the years.

Furthermore, players are likely to develop preferences in the design and shape of their protective gloves. Protective gloves are especially susceptible to changes in design preferences by players. Some players will prefer a protective glove that covers only a small portion of the lower forearm because it affords more freedom to the wrist. Others will feel more comfortable with a higher protective glove that covers a substantial part of the lower forearm. Most often, when a player wishes to change size and/or design characteristics of the protective gloves, he or she must consider the protection of the general elbow area as well, and often may have to replace the elbow pads to properly cover the new gap defined between the new protective gloves. For example, when new protective gloves are purchased that present a shorter wrist cuff and lower forearm protector, the elbow pads may no longer properly protect the forearms and should be replaced to accommodate the new gap defined by the new protective gloves. This also adds to the replacement cost of the protective gloves.

Thus, there is a need in the sports industry for an elbow pad capable of being used in conjunction with a variety of protective gloves of different sizes and various design characteristics while adequately protecting the elbow and forearm of the player.

OBJECTS AND STATEMENT OF THE INVENTION

It is thus an object of the invention to provide an elbow pad, which is adapted to cover varying gaps between the protective glove and the shoulder pad.

It is a further object of the invention to provide an elbow pad, which can accompany a young player through an increased number of years while he or she is growing.

It is another object of the invention to provide an elbow pad, which reduces the replacement cost of protective equipment in general and specifically through the development stages of a player.

As embodied and broadly described herein, the invention provides an adjustable elbow pad for playing hockey and similar sporting activities comprising the combination of an elbow protector and a forearm protector. The elbow protector has a first limb encircling element comprising a padding component and defining an upper arm protector, a second limb encircling element comprising a padding component and defining a lower arm protector, and a rigid shell bridging the first and second limb encircling elements. The forearm protector has a third limb encircling element comprising a padding component and a protective plate secured to the third limb encircling element. The elbow pad also comprises a rigid tongue extending between the elbow protector and the forearm protector for telescopingly joining same together, and locking means cooperating with the rigid tongue for locking the forearm protector to the elbow protector at least when worn.

Advantageously, the distance between the forearm protector and the elbow protector is adjustable. Furthermore, the diameter of the first and second limb encircling elements is also adjustable. In a variant of the invention, the elbow pad further comprises an inner arm protector covering a widening gap between the forearm protector and the elbow protector. The inner arm protector is preferably connected to the lower arm protector of the elbow protector.

Other objects and features of the invention will become apparent by reference to the following description and the drawings.

BRIEF DESCRIPTION OF THE DRAWINGS

A detailed description of embodiments of the present invention is provided herein below, by way of example only, with reference to the accompanying drawings, in which.

Figure 1:
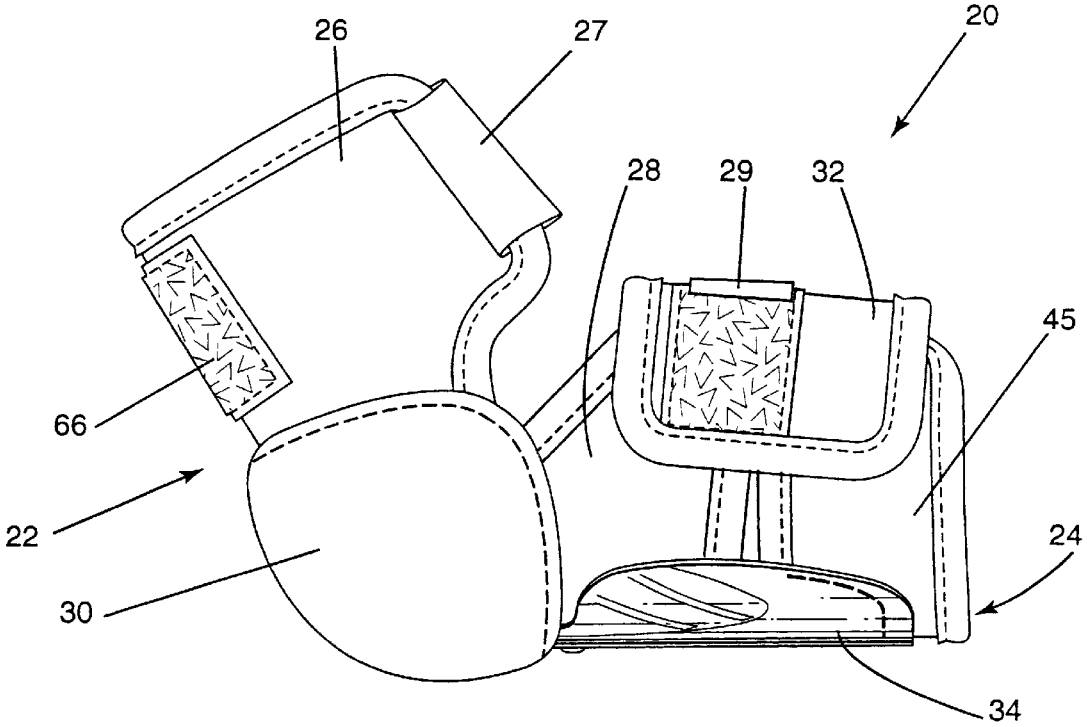
FIG. 1 is an outer side elevational view of an adjustable elbow pad shown fully contracted.
Figure 2:
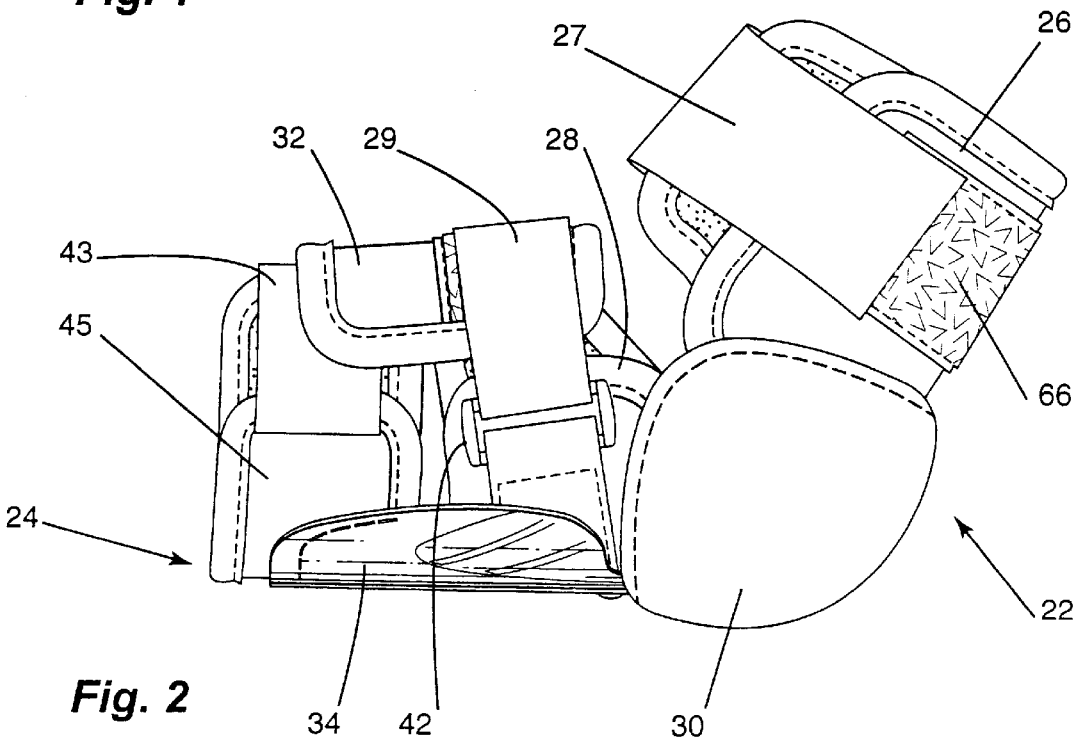
FIG. 2 is an inner side elevational view of the elbow pad illustrated in FIG. 1 also shown fully contracted.
Figure 3:
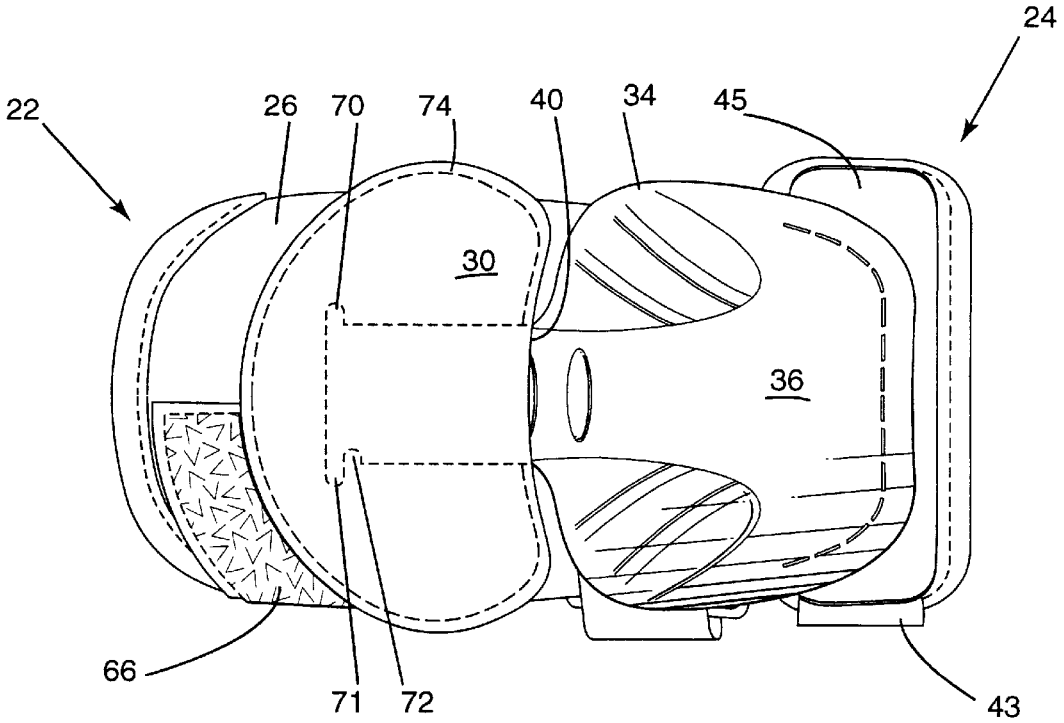
FIG. 3 is a bottom plan view of the elbow pad illustrated in FIG. 1 also shown fully contracted.
Figure 4:
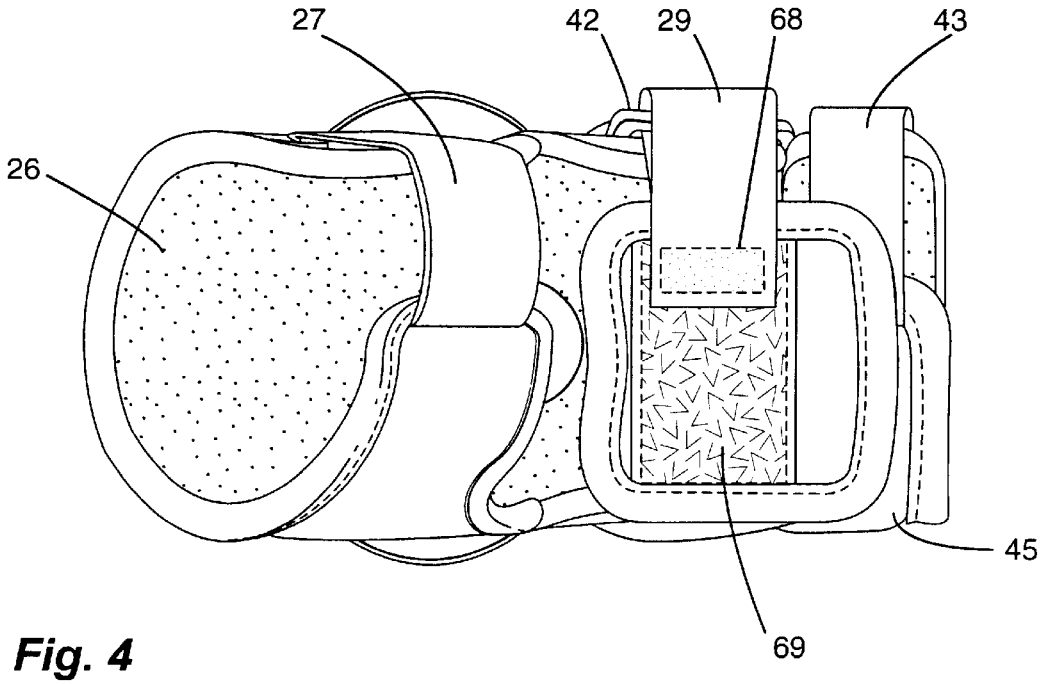
FIG. 4 is a top plan view of the elbow pad illustrated in FIG. 1 also shown fully contracted.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENTS

FIGS. 1 to 4 illustrate an adjustable elbow pad constructed in accordance with the invention, which is generally designated by the reference numeral 20. The elbow pad 20 includes an elbow protector 22 and a forearm protector 24. Elbow protector 22 comprises an upper arm protector 26 and a lower arm protector 28 strapped to portions of the upper arm and lower arm respectively for protecting the surrounding areas of the elbow joint. Upper arm protector 26 and lower arm protector 28 are made of a padding material which is shaped and formed to cover portions of the arm immediately above and below the elbow. An elbow shell 30 is sewn or otherwise connected to the middle portion of the padding material between upper arm protector 26 and lower arm protector 28, directly at the elbow point, bridging upper arm protector 26 and lower arm protector 28. Elbow shell 30 is made of a rigid material and is shaped in such a manner as to partially enclose, and thus protect, the fragile area defined by the elbow point. As will be described in greater detail below, an inner padding element underlies elbow shell 30 and thereby cushions this region. An inner arm protector 32, also made of a suitable padding material, is connected to lower arm protector 28. It covers and protects the inside portion of the lower arm. A hooks and loops strap fastener 27 is provided for retaining upper arm protector 26 to the upper arm. A suitable hooks and loops fastener is sold under the trade-mark VELCRO.

Inner arm protector 32 is sewn or otherwise connected to one side of lower arm protector 28. A strap 29 comprising a hooks section 68 is sewn to the same side of lower arm protector 28. Strap 29 is passed through a ring 42 provided on the other side of lower arm protector 28. Inner arm protector 32 is positioned over lower arm protector 28. Strap 29 is then folded over inner arm protector 32 and hooks section 68 is fastened onto loops section 69 provided on the outer surface of inner arm protector 32. This combination allows tightening of lower arm protector 28 around the lower arm and maintains inner arm protector 32 in its proper location as shown.

Figure 5:
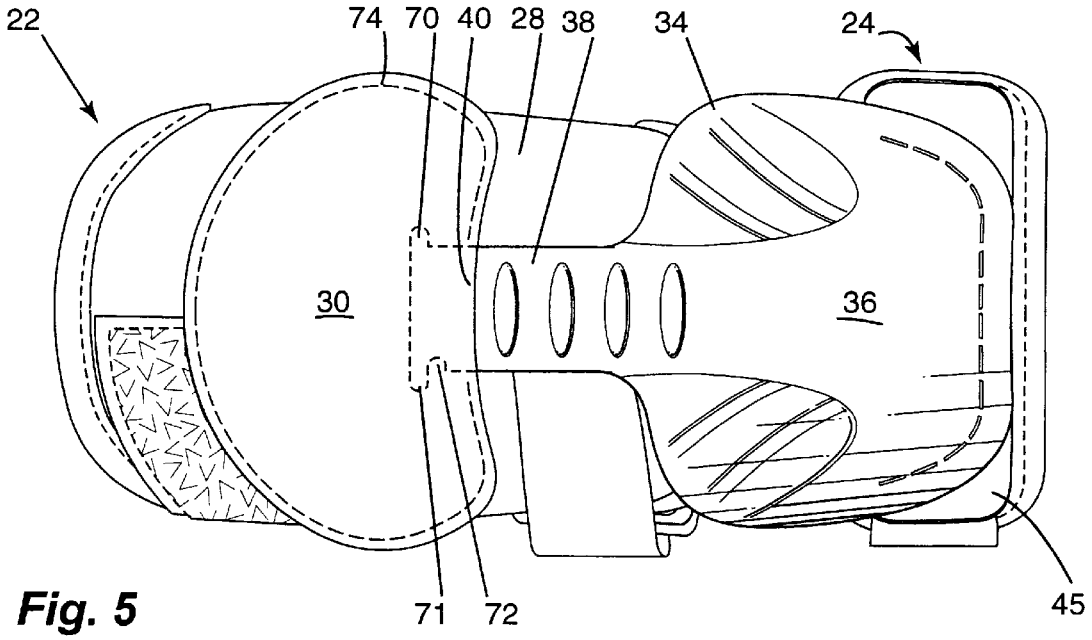
FIG. 5 is a bottom plan view of the elbow pad illustrated in FIG. 1 shown fully extended.
Figure 6:
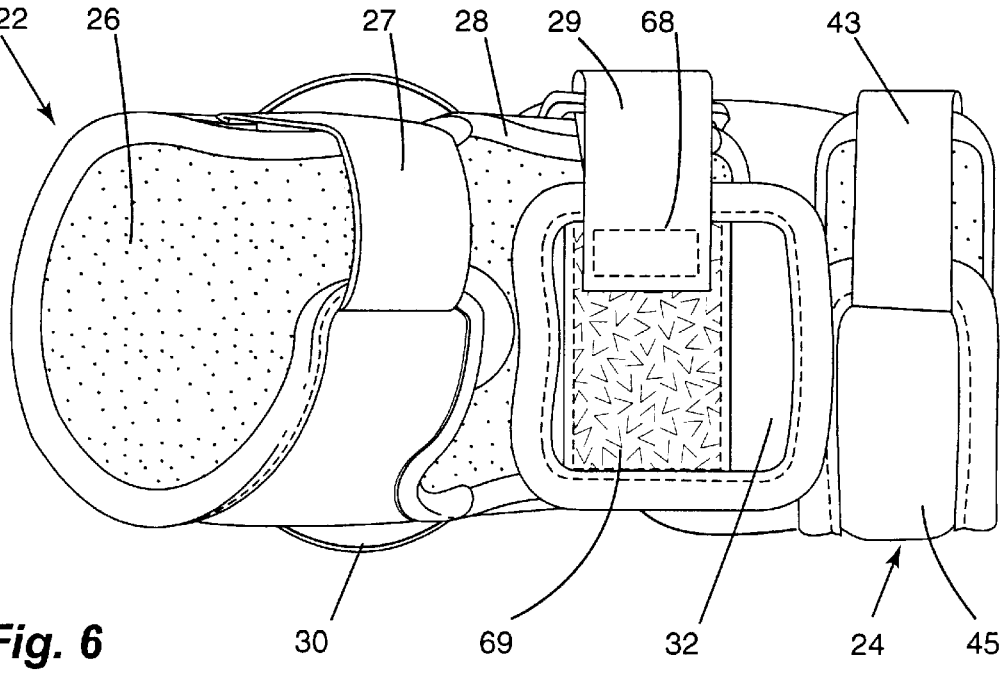
FIG. 6 is a top plan view of the elbow pad illustrated in FIG. 1 also shown fully extended.

Forearm protector 24 comprises a padded bracelet 45 sewn or otherwise connected to a forearm guard 34 which is made of a rigid material. As best shown in FIGS. 5 and 6, forearm guard 34 comprises a protective plate 36 directly connected to padded bracelet 45 and covering the width of the forearm, and a tongue 38 extending from protective plate 36 to elbow shell 30 and inserted into an aperture 40. Forearm guard 34 is adapted to telescopingly connect forearm protector 24 to elbow protector 22. Aperture 40 may be defined by any convenient passage means such as an interruption of the stitching 74 holding elbow shell 30 to lower arm protector 28. Aperture 40 leads into a space between elbow shell 30 and lower arm protector 28 which is host to tongue 38. The end portion of tongue 38, shown in dotted lines in FIGS. 3 and 5, comprises two lateral extensions 70 and 71 which prevent accidental withdrawal of forearm guard 34 from elbow shell 30 via aperture 40. A cut 72 is provided below one of the two lateral extensions 70 or 71. In the example shown in FIGS. 3 and 5, the cut 72 is under lateral extension 71. Cut 72 enables the removal or insertion of forearm guard 34 into or out of aperture 40. Tongue 38 is inserted into aperture 40 by first inserting lateral extension 71 and then sliding it sideways using cut 72, which thereby enables lateral extension 70 to clear the opposite side of aperture 40. The removal of tongue 38 is done in similar fashion. A flexible strap 43 made of an elastic material is provided for retaining padded bracelet 45 to the forearm of the player.

Figure 7:
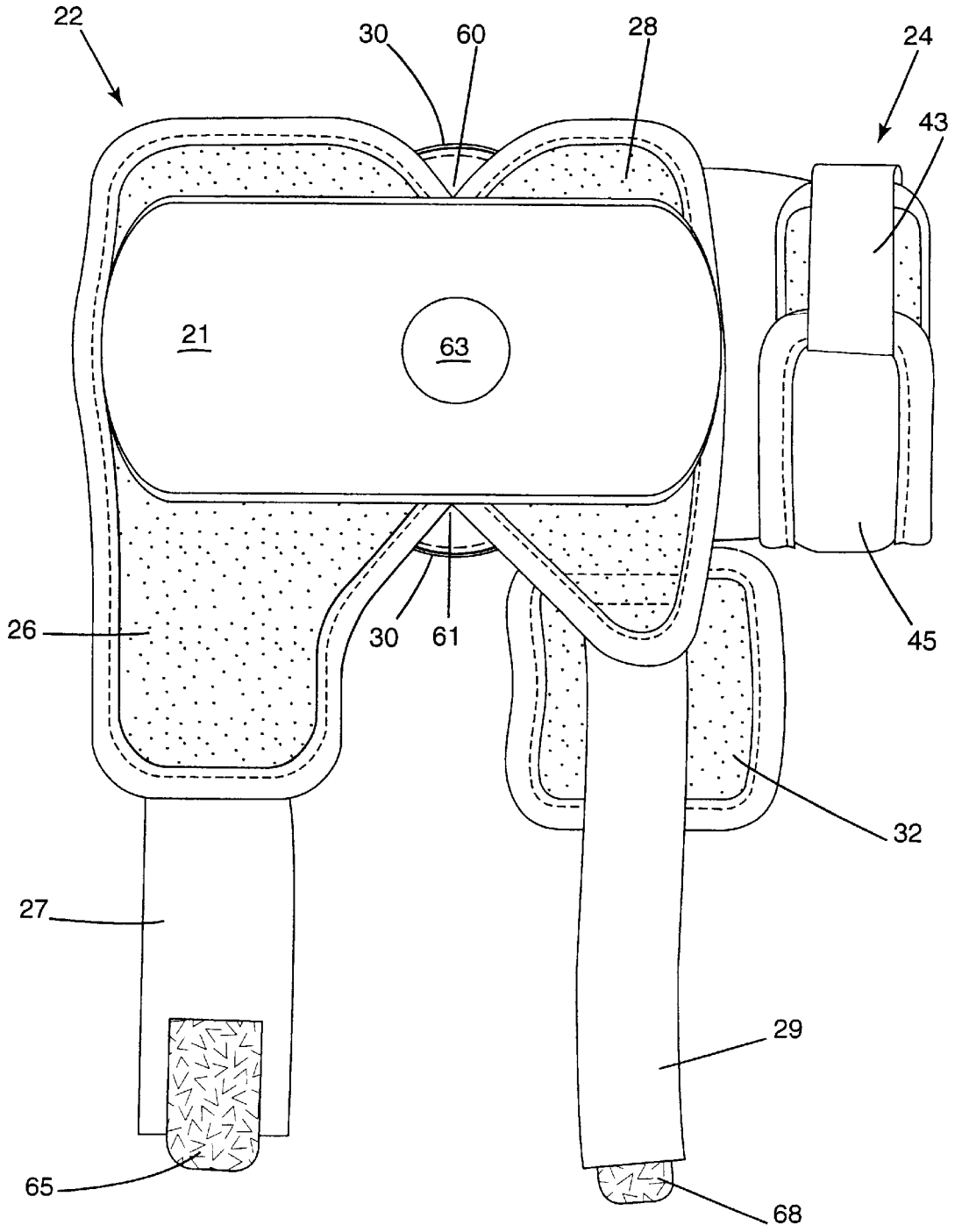
FIG. 7 is an inside view of the elbow pad of FIG. 1 when laid open, unfastened, and fully extended.
Figure 8:
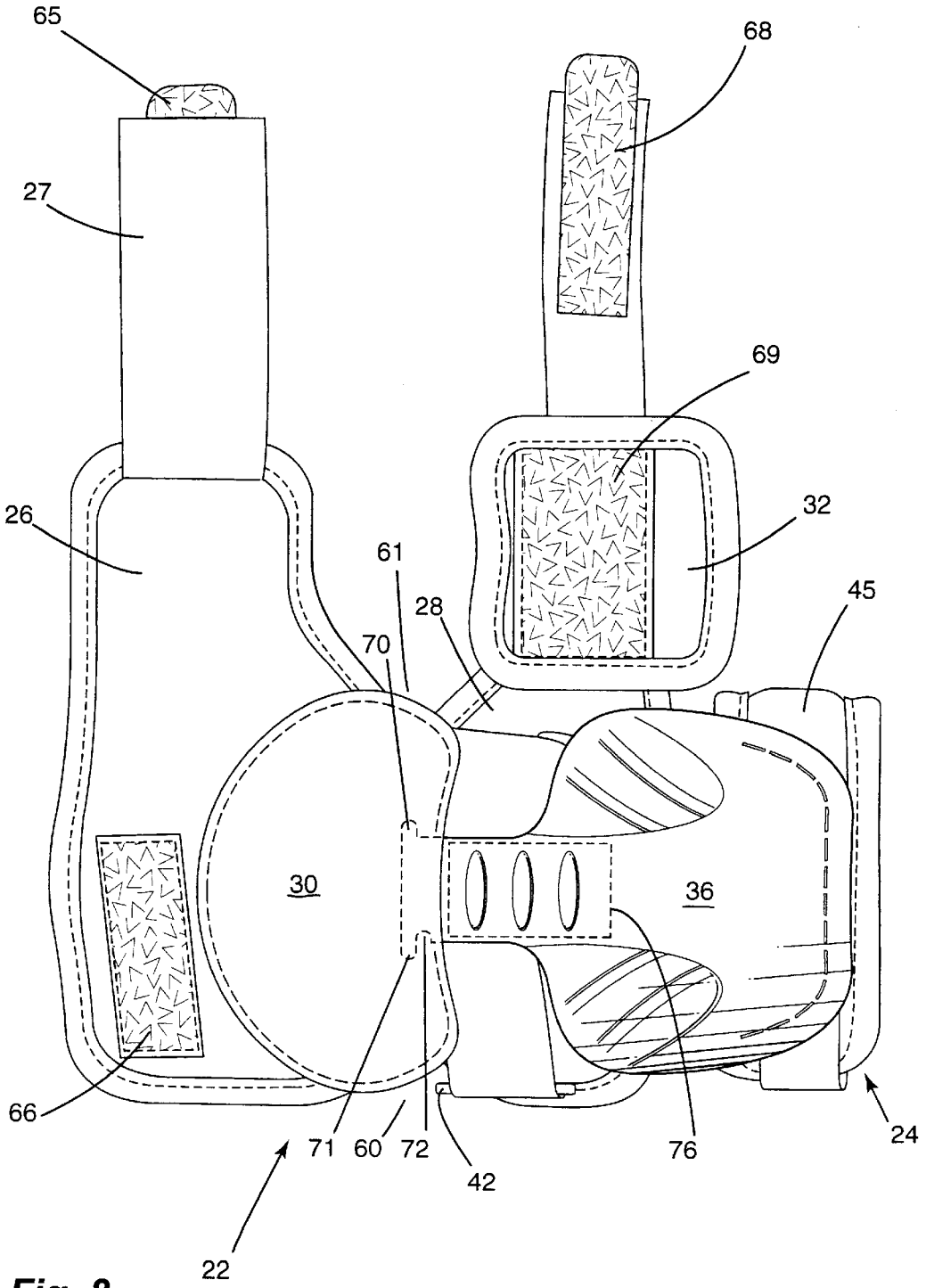
FIG. 8 is an outside view of the elbow pad of FIG. 1 in the same condition as in FIG. 7.

FIGS. 7 and 8 respectively illustrate the inside and outside of elbow protector 22 when the latter has been laid flat and unfastened. Upper and lower arm protectors 26 and 28 are sewn or otherwise connected together at their adjacent edges. An inner padding element 21 is also sewn to the inside surface of upper and lower arm protectors 26 and 28. In order to accommodate the elbow point when elbow pad 20 is worn, a circular recess 63 is shaped in padding element 21; circular recess 63 being situated approximately in the central region of elbow pad 20. Upper and lower arm protectors 26 and 28 are shaped and connected together to form zones of flexure 60 and 61 which enable easy flexing of elbow protector 22 when in use. Strap 27 is sewn or otherwise connected to one side of upper arm protector 26 and provided with a section of hooks 65 while a loops section 66 is provided on the outer surface of upper arm protector 26 to enable fastening of the latter. Strap 29 is also sewn or otherwise connected to one side of lower arm protector 28. A hooks section 68 is provided on strap 29 while a loops section 69 is provided on the outer surface of inner arm protector 32. To fasten lower arm protector 28, strap 29 is inserted into ring 42 and folded onto the loops section 69 of inner arm protector 32.

The padding material used can be any suitable material or composition capable of absorbing energy to provide the degree of cushioning and protection desired, such as a relatively thick foam material covered by layers of woven synthetic yarn. More particularly, the padding material may comprise a closed cell foam of ethylene vinyl acetate of a thickness of 4 to 8 mm covered by mesh outer layers of woven synthetic material such as polyester. The padding material may also comprise a polystyrene, a polyurethane foam, or a rubber foam. The inner layer of the padding material, which is in contact with the skin, is usually a cotton or a synthetic flannel fabric which is non-abrasive so that it is comfortable to the user.

Figure 9:
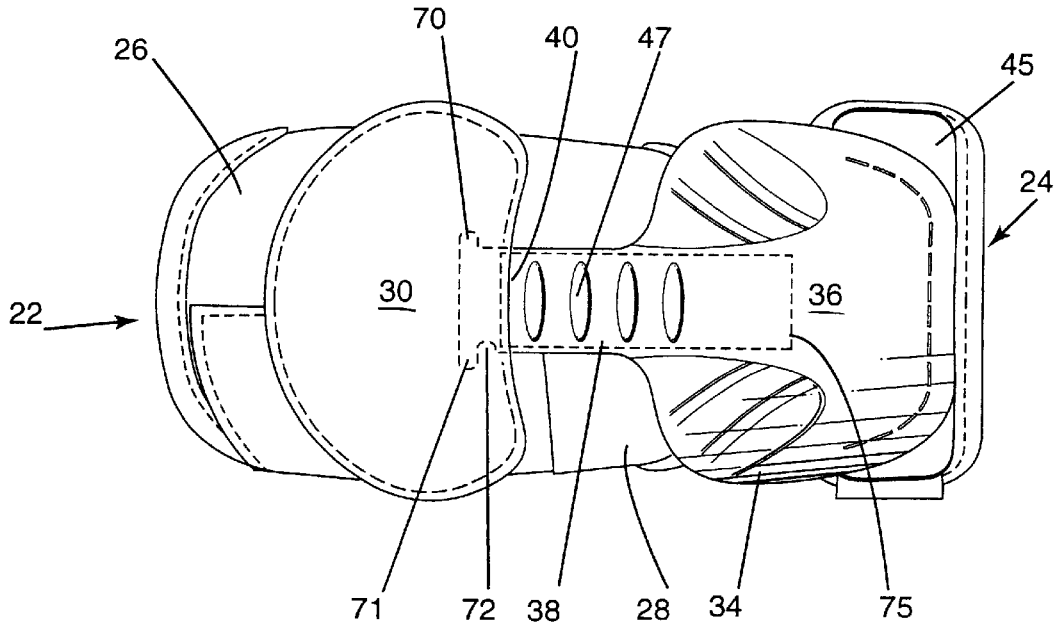
FIG. 9 is a bottom plan view of the elbow pad illustrated in FIG. 1 shown fully extended.

Forearm protector 24 is adapted to assume a plurality of positions in relation to elbow protector 22. FIGS. 1 through 4, for example, illustrate elbow pad 20 in its fully contracted position while FIGS. 5, 6 and 9 illustrate elbow pad 20 in its fully extended position. In order to assume these differing positions, tongue 38 is adapted to move back and forth inside aperture 40 and thereby vary the position of forearm protector 24 relative that of elbow protector 22. A hooks and loops fastener is used between tongue 38 and lower arm protector 28 to effectively lock forearm protector 24 at a desired position in relation to elbow protector 22. A hooks section 75, as shown in dotted lines in FIG. 9, is glued to the inner side of forearm guard 34 and extends from the end of tongue 38 to padded bracelet 45. The corresponding loops section 76 shown in FIG. 8 is positioned on lower arm protector 28 and extends from aperture 40 to the edge of lower arm protector 28. Adjustment ribs 47 are also provided on the surface of tongue 38 to help the user in choosing the desired adjustment of elbow pad 20. Inner arm protector 32 is adapted to cover a portion of the gap left between padded bracelet 45 and lower arm protector 28 when elbow pad 20 is in its fully extended state.

Elbow pad 20 may thus be adjusted in length to properly protect the elbow area of the arm. More specifically, elbow pad 20 can be adjusted to protect a widening gap between a protective glove and a shoulder pad as a young player grows. The adjustment capabilities of elbow pad 20 add years of use to the elbow pad. Furthermore, the use of hooks and loops fasteners to retain upper arm protector 26 and lower arm protector 28 provides an adjustment means for accommodating the growing diameter of the arm of the young player. Elbow pad 20 is therefore adapted to be used by a young player for many years as he or she is growing. Elbow pad 20 may also be used by different players of various sizes since it can be adjusted in length and diameter.

Figure 10A:
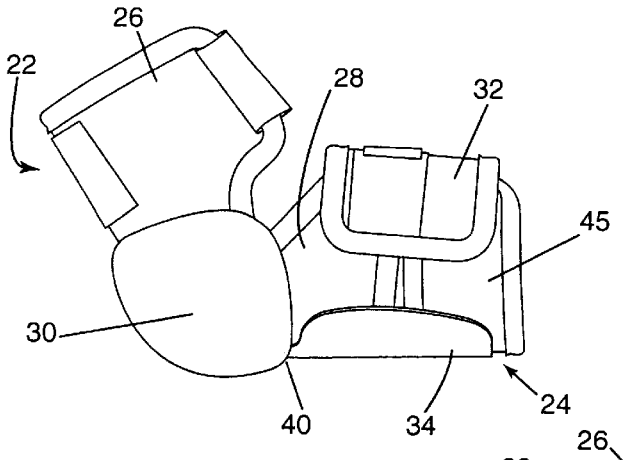
FIG. 10*a* is a side elevational view of the elbow pad illustrated in FIG. 1 shown fully contracted.
Figure 10B:
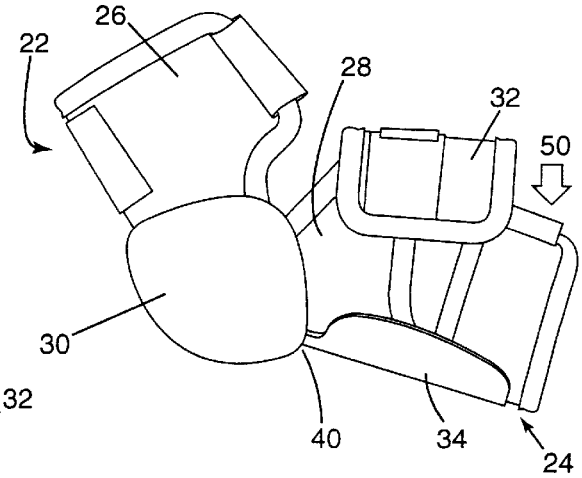
FIG. 10*b* is a side elevational view of the first step necessary to adjust the length of the elbow pad of FIG. 10*a;*
Figure 10C:
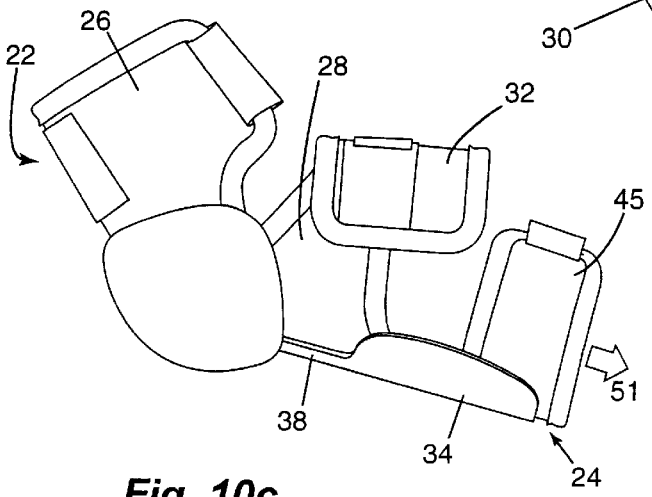
FIG. 10*c* is a side elevational view of the second step necessary to adjust the length of the elbow pad of FIG. 10*a;*
Figure 10D:
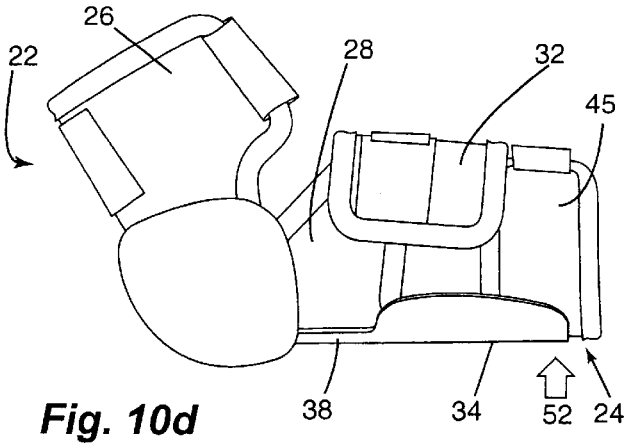
FIG. 10*d* is a side elevational view of the third step necessary to adjust the length of the elbow pad of FIG. 10*a;*

FIGS. 10*a* through 10*d* illustrate the steps required to adjust the length of elbow pad 20. FIG. 10*a* depicts elbow pad 20 in the fully contracted position. The padded bracelet 45 is nearly touching lower arm protector 28, tongue 38 is completely inside aperture 40 and inner arm protector 32 overlays a large portion of padded bracelet 45. To adjust the position of forearm protector 24, as shown in FIG. 10*b*, forearm guard 34 must first be disengaged from lower arm protector 28 by moving forearm protector 24 downwardly in the direction of arrow 50 to pull apart the hooks and loops fastener which keep forearm guard 34 locked to lower arm protector 28. Once disengaged, forearm protector 24 may be moved away from elbow protector 22 by sliding tongue 38 outwardly as indicated by arrow 51 in FIG. 10*c*. At the desired position, forearm guard 34 is moved upwardly as indicated by arrow 52; the hooks and loops fastener are re-engaged locking forearm guard 34 to lower arm protector 28 in the new position as shown in FIG. 10d. In this new position, it can be seen that inner arm protector 32 partially covers the space between padded bracelet 45 and lower arm protector 28.

Figure 11A:
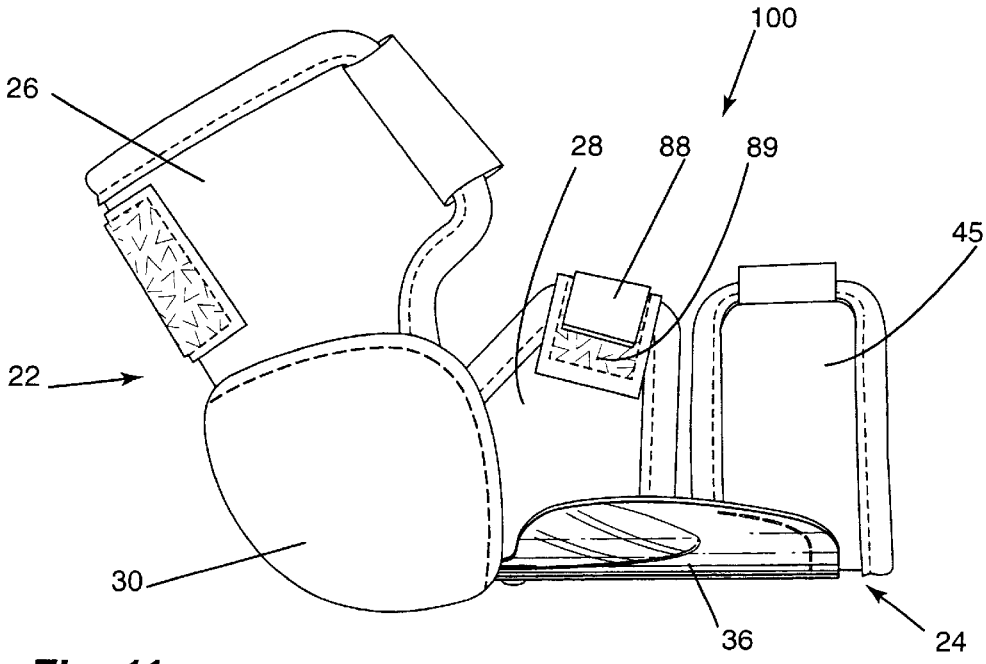
FIG. 11*a* is an outer side elevational view of an adjustable elbow pad constructed in accordance with a second embodiment of the invention.
Figure 11B:
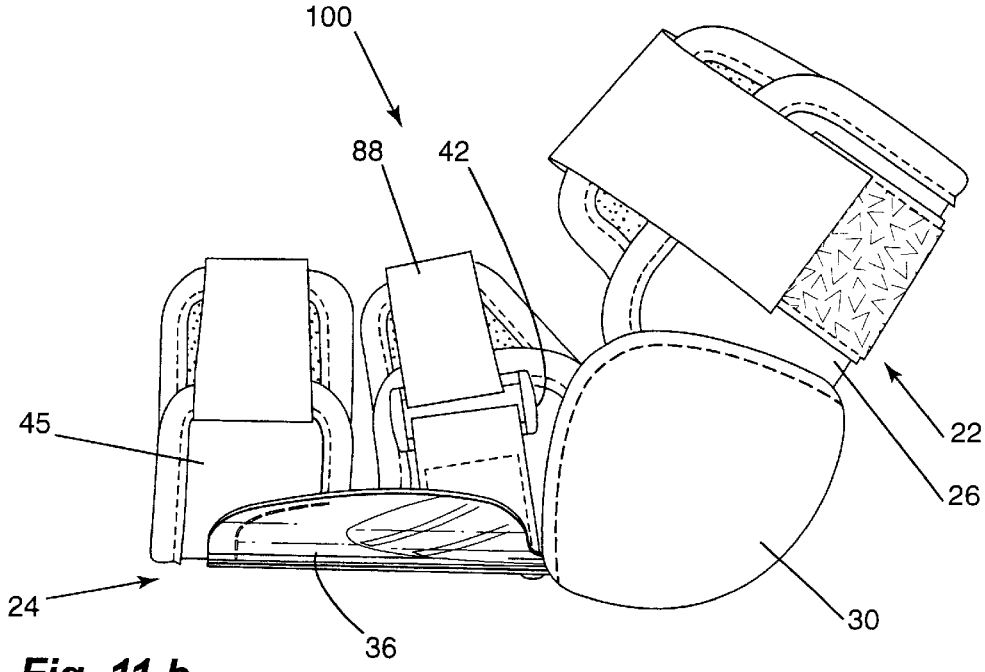
FIG. 11*b* is an inner side elevational view of the elbow pad illustrated in FIG. 11*a;*

FIGS. 11*a* and 11*b* illustrate an alternative embodiment 100 of an elbow pad in accordance with the present inventive concept and in which inner arm protector 32 has been removed. Elbow pad 100 is constructed and adjusted in the same manner as it was in the previous embodiment shown in FIGS. 1 to 10*d*. However, strap 88 comprises a hooks section and a loops section 89. Strap 88 is sewn or otherwise attached to one side of lower arm protector 28, inserted through ring 42, folded over and fastened together using a hoops and loops fastener 89. Elbow pad 100 without inner arm protector 32 is somewhat lighter and less restrictive.

Figure 12:
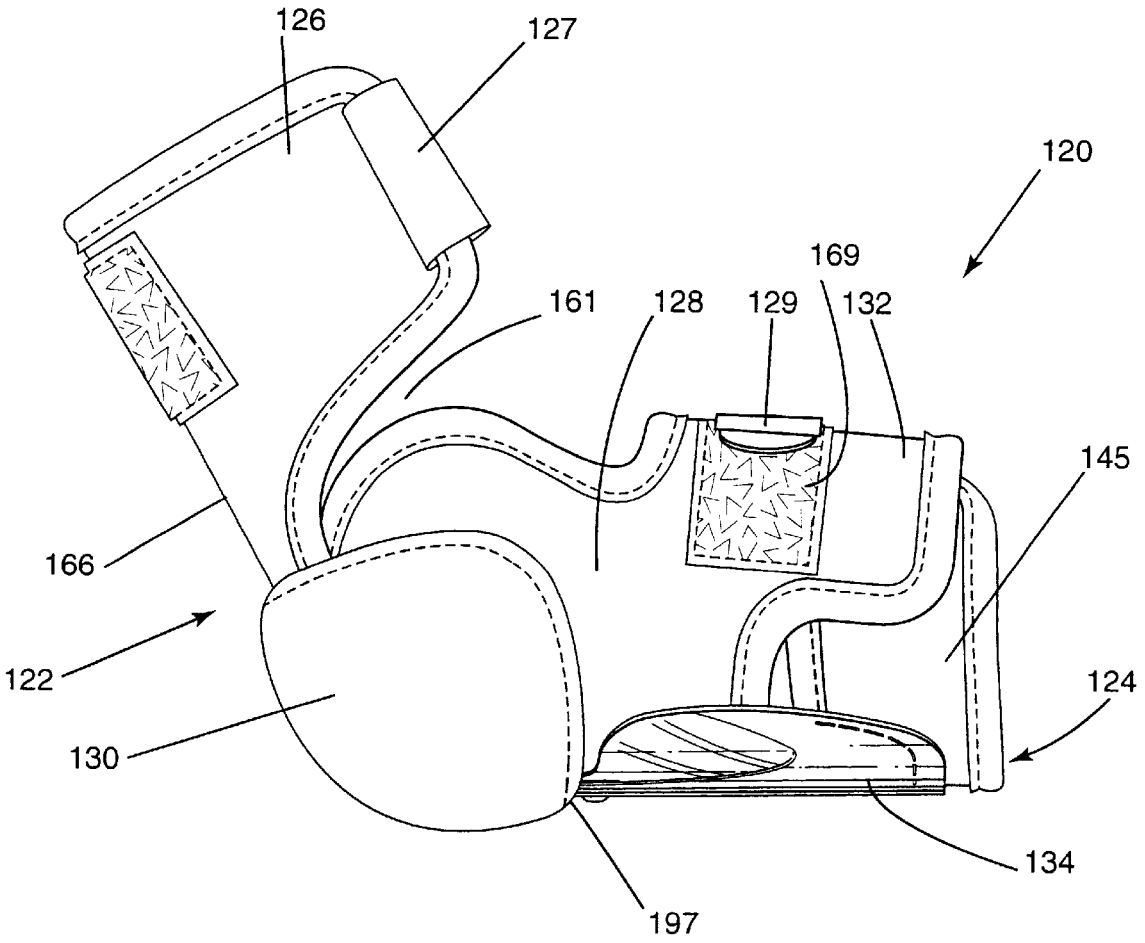
FIG. 12 is an outer side elevational view of an adjustable elbow pad constructed in accordance with a third embodiment of the invention.
Figure 13:
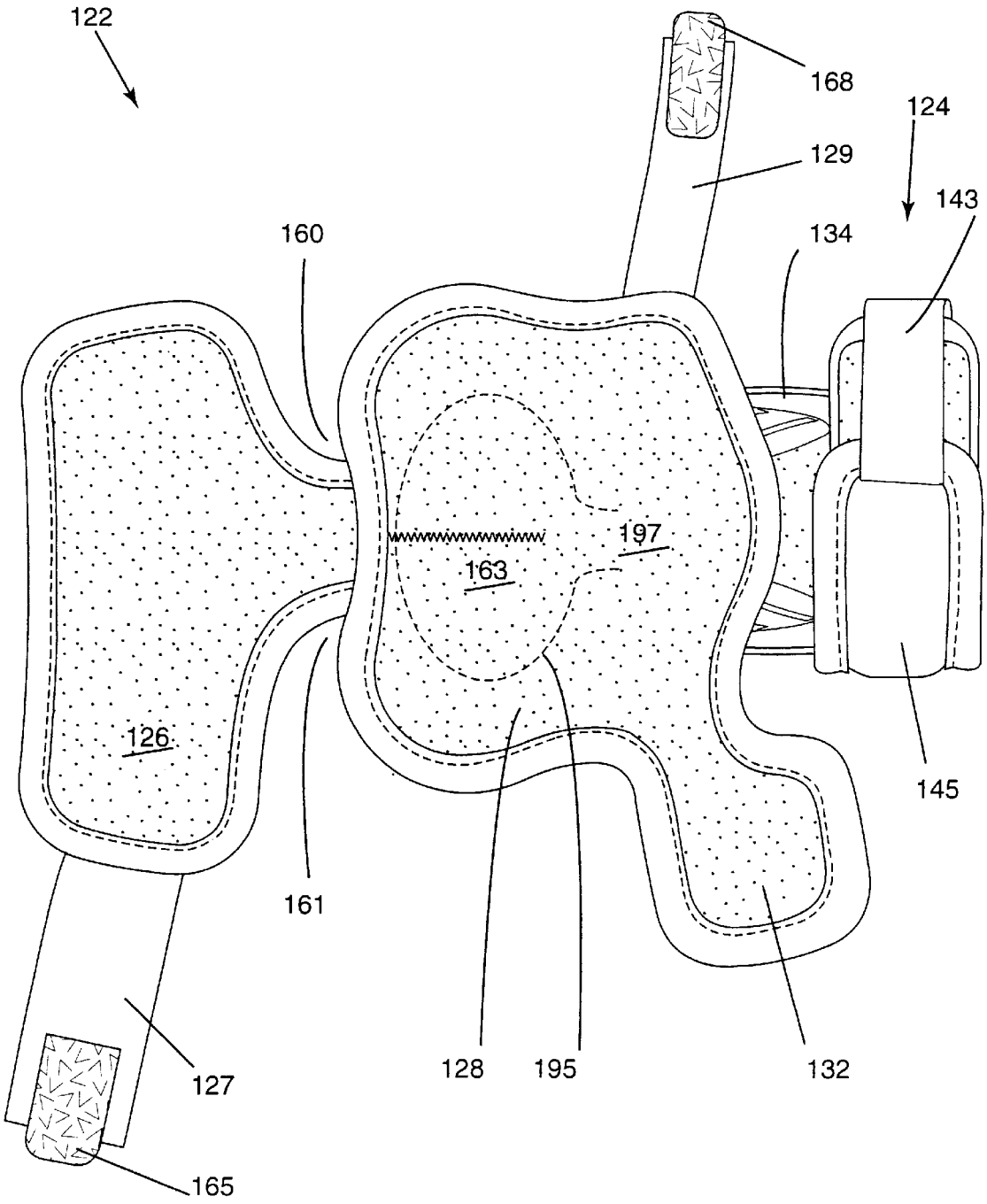
FIG. 13 is an inside view of the elbow pad of FIG. 12 when laid open, unfastened, and fully extended.

FIGS. 12 and 13 depict another embodiment of the present invention. As depicted in the figures, elbow pad 120 includes an elbow protector 122 and a forearm protector 124. Elbow protector 122 comprises an upper arm protector 126 and a lower arm protector 128 that are adapted to encircle portions of the upper and lower arms respectively. Elbow protector 122 further comprises a rigid elbow shell 130 that is adapted to partially enclose the outer area of the elbow point. Upper and lower arm protectors 126 and 128 are sewn or otherwise attached to elbow shell 130 in such a manner as to provide flexibility to the elbow protector 122. As shown in FIG. 13, upper arm protector 126 is first sewn to lower arm protector 128 and the assembly (126, 128) is subsequently sewn to elbow shell 130 via stitching lines 195 to complete the elbow protector 122. With respect to forearm protector 124, the latter includes a limb encircling padded bracelet 145 sewn or otherwise connected to a rigid forearm guard 134.

As depicted in FIG. 13, the lower portion of upper arm protector 126 that is attached to elbow shell 130 is considerably narrow when compared to the width of lower arm protector 128. As a result, flexure zones 160, 161 are created between lower arm protector 128 and upper arm protector 126. These flexure zones 160, 161 in conjunction with the above-mentioned narrow portion yield a wide range of motion between upper arm protector 126 and elbow shell 130. Such a feature is desirable in order to not compromise the dexterity of the wearer when the elbow pad is in use.

FIGS. 12 and 13 also show that lower arm protector 128 is extended in this embodiment. It therefore underlies the entire elbow shell 130 and fully encloses the elbow of the wearer. As illustrated more specifically in FIG. 12, the contours of the lower and upper arm protectors 126, 128 are complementary such that in a normal elbow position, the sides of the arm are not unduly exposed to blows. Moreover, lower arm protector 128 is fully padded and is characterized by an oval recess 163. Oval recess 163, defined by sewing lines 195 which secure lower arm protector 128 to elbow shell 130, is shaped so as to accommodate the elbow point when the elbow pad 120 is worn. Lower arm protector 128 further comprises an inner arm protector 132 that is an integral part of lower arm protector 128 as well as a strap 129 having a hooks section 168. When the user puts the adjustable elbow pad 120 on, he or she simply pulls the strap 129 and couples its hooks section 168 to the loops section 169 of inner arm protector 132. The arm of the wearer is thereby encircled and secured in a snug fashion.

Elbow pad 120 also comprises a forearm protector 124 that is telescopingly coupled to elbow shell 130 via a rigid forearm guard 134; the latter also being characterized by a tongue (not shown) that is adapted to move back and forth within an aperture 197. The aperture 197 is located between the elbow shell 130 and the lower arm protector 128 and is defined by an interruption in the sewing lines 195. Thus, it is possible to modify the position of the forearm protector 124 relative to that of the elbow shell 130 by simply modifying the length of the rigid tongue that is dissimulated within the aperture 197. In order to lock the forearm protector 124 in place when the latter is at its desired location, a hooks and loops fastener, similar to that described in relation to the previous embodiments, is used between the tongue and the lower arm protector 128. More specifically, a hooks section (not shown) is adhered onto the inner side of forearm guard 134 and extends from the end of the tongue to the padded bracelet 145. Moreover, the corresponding loops section (not shown) is positioned on lower arm protector 128 and extends from the aperture to the edge of the lower arm protector 128. It should also be noted that the rigid tongue also features adjustment ribs to assist the user in choosing the specific length of the elbow pad 120 that most accurately meets his or her needs.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. An adjustable elbow pad for playing hockey and similar sporting activities comprising the combination of an elbow protector and a forearm protector, said elbow protector having a first limb encircling element defining an upper arm protector, a second limb encircling element defining a lower arm protector, a rigid shell bridging said first and second limb encircling elements; said forearm protector having a third limb encircling element and a protective plate secured to said third limb encircling element; said elbow pad also comprising a rigid tongue extending between said elbow protector and said forearm protector for telescopingly joining said elbow protector to said forearm protector, and locking means cooperating with said rigid tongue for locking said forearm protector to said elbow protector at least when in use.

2. An adjustable elbow pad as defined in claim 1 wherein the distance between said forearm protector and said elbow protector is adjustable.

3. An adjustable elbow pad as defined in claim 2 wherein the diameter of said first and second limb encircling elements is adjustable.

4. An adjustable elbow pad as defined in claim 3 wherein said first and second limb encircling elements further comprise straps adapted to tighten said first and second limb encircling elements over the arm of the player.

5. An adjustable elbow pad as defined in claim 4 wherein said straps comprise hooks and loops fasteners.

6. An adjustable elbow pad as defined in claim 1 wherein said rigid tongue and said protective plate are integrally connected.

7. An adjustable elbow pad as defined in claim 1 wherein said locking means is a hooks and loops fastener.

8. An adjustable elbow pad as defined in claim 7 wherein said hooks and loops fastener is positioned between an inner side of said rigid tongue and an outer side of said lower arm protector.

9. An adjustable elbow pad as defined in claim 8 wherein said elbow protector further comprises an aperture in which said rigid tongue is inserted, said rigid tongue adapted to slide longitudinally inside said aperture.

10. An adjustable elbow pad as defined in claim 9 wherein said aperture is located between said rigid shell and said lower arm protector.

11. An adjustable elbow pad as defined in claim 1 further comprising an inner arm protector covering a varying gap between said forearm protector and said elbow protector.

12. An adjustable elbow pad as defined in claim 11 wherein said inner arm protector is connected to said lower arm protector of said elbow protector.

13. An adjustable elbow pad as defined in claim 11, wherein said inner arm protector is integrally connected to said lower arm protector of said elbow protector.

14. An adjustable elbow pad as defined in claim 1, wherein said lower arm protector comprises an integral padding element.

15. An adjustable elbow pad for playing hockey and similar sporting activities, said adjustable elbow pad comprising:

an elbow protector including:

a) an upper arm protector comprising a first limb encircling element, said first limb encircling element comprising a padding component;

b) a lower arm protector comprising a second limb encircling element, said second limb encircling element comprising a padding component;

c) an elbow shell adapted to partially enclose the user's elbow point, said elbow shell integrally coupled to said upper arm protector and said lower arm protector;

a forearm protector comprising a third limb encircling element, said third limb encircling element comprising a padding component; and adjusting means for joining said elbow protector and said forearm protector, said adjusting means being capable of varying the position of said forearm protector relative to the position of said elbow protector.

16. An adjustable elbow pad as defined in claim 15 wherein the diameter of said first and second limb encircling elements is adjustable.

17. An adjustable elbow pad as defined in claim 16, wherein said first and second limb encircling elements further comprise straps adapted to tighten said first and second limb encircling elements over the arm of the player.

18. An adjustable elbow pad as defined in claim 17 wherein said straps comprise hooks and loops fasteners.

19. An adjustable elbow pad as defined in claim 15 wherein said adjustable elbow pad further comprises locking means operative for locking said forearm protector to said elbow protector at least when in use.

20. An adjustable elbow pad as defined in claim 19 wherein said locking means is a hooks and loops fastener.

21. An adjustable elbow pad as defined in claim 15, further comprising an inner arm protector covering a varying gap between said forearm protector and said elbow protector.

22. An adjustable elbow pad as defined in claim 21 wherein said inner arm protector is connected to said lower arm protector of said elbow protector.

23. An adjustable elbow pad as defined in claim 21, wherein said inner arm protector is integrally connected to said lower arm protector of said elbow protector.

24. An adjustable elbow pad for playing hockey and similar sporting activities, said adjustable elbow pad comprising:

an elbow protector including:

a) an upper arm protector comprising a first limb encircling element, said first limb encircling element comprising a padding component;

b) a lower arm protector comprising a second limb encircling element, said second limb encircling element comprising a padding component, said lower arm protector including an inner arm protector for protecting the inner forearm region of the wearer while in use;

c) an elbow shell bridging said upper arm protector and said lower arm protector;

a forearm protector comprising a third limb encircling element, said third limb encircling element comprising a padding component;

a protective plate fixedly connected to the outer region of said forearm protector, said protective plate comprising a rigid tongue extending from one extremity and adapted to engage an aperture in said elbow protector, said rigid tongue joining said elbow protector to said forearm protector and being operative to vary the position of said forearm protector relative that of said elbow protector; and an inner padding element underlying said lower arm protector.

* * * * *